US005437129A

United States Patent [19]

Konstantin

[11] Patent Number: 5,437,129

[45] Date of Patent: Aug. 1, 1995

[54] FIRE RESISTANT SKYLIGHT STRUCTURE

[75] Inventor: Moshe Konstantin, Highland Park, Ill.

[73] Assignee: Clear Plastics International, Inc., Mundelein, Ill.

[21] Appl. No.: 3,772

[22] Filed: Jan. 13, 1993

[51] Int. Cl.[6] ..... E04B 7/18

[52] U.S. Cl. ..... 52/200

[58] Field of Search ..... 52/200, 202, 203

[56] References Cited

U.S. PATENT DOCUMENTS

| | | | |
|---|---|---|---|
| 3,044,159 | 7/1962 | Lercr | 52/203 |
| 4,074,480 | 2/1978 | Burton | 52/202 X |
| 4,114,331 | 9/1978 | Yamamoto | 52/202 |
| 4,333,284 | 6/1982 | Meadows | 52/202 X |
| 4,514,945 | 5/1985 | Menchetti | 52/203 X |
| 4,562,675 | 1/1986 | Baiggs | 52/203 X |
| 4,570,394 | 2/1986 | Jentoft | 52/200 X |
| 4,577,619 | 3/1986 | Howe | 52/200 X |
| 4,680,905 | 7/1987 | Rockar | 52/200 |
| 4,750,302 | 6/1988 | Bechtolo | 52/200 X |
| 4,930,275 | 6/1990 | Verby | 52/200 |
| 4,963,534 | 8/1984 | Crigler | 52/200 X |
| 4,986,039 | 1/1991 | Weisner | 52/200 X |

*Primary Examiner*—Carl D. Friedman
*Assistant Examiner*—Beth A. Aubrey
*Attorney, Agent, or Firm*—Fitch, Even, Tabin & Flannery

[57] ABSTRACT

Disclosed is a skylight structure capable of meeting the ASTM E-108 Class A fire rating requirements. In the illustrated embodiment, the structure comprises upper and lower thermoplastic panels maintained in parallel spaced relation by a gridwork of transversely extending metal beams, which maintain a metal screen taut adjacent the lower polymeric panel, and a layer of light transmitting insulating material disposed immediately above the screen. The metal gridwork and metal screen assure that no burning particles pass through the skylight structure and into the building, so that the upper and lower panels may be formed of very efficient light transmitting thermoplastics and do not need to be formed of thermoset plastics, which are less efficient at light transmission, but previously employed for its retardation characteristics. Hence, the disclosed skylight structure provides improved light transmission and improved fire resistance over currently manufacture skylights.

18 Claims, 2 Drawing Sheets

FIRE RESISTANT SKYLIGHT STRUCTURE

FIELD OF THE INVENTION

This invention relates to skylights, and more particularly, relates to a skylight having plastic panels which is capable of meeting fire safety criteria.

BACKGROUND OF THE INVENTION

Transparent or translucent domes or skylight structures of various kinds are currently in use in buildings throughout the world. Such structures are generally provided in a portion of a roof, allowing sunlight to pass through the skylight portion of the roof and illuminate interior regions of the building. Skylights have gained increasing usage in recent years due to the energy conservation which they afford.

Fire safety criteria have also become increasingly important in recent years, due at least in part to increased density in urban areas. The American Society for the Testing of Materials has established criteria for rating the performance of roofing materials subjected to fire conditions which are published in ASTM E-108 (1983) entitled, "Tests For Fire Resistance of Roof Covering Materials." The highest rating awarded is "Class A" which indicates that the skylight is effective against severe fire exposures. To receive a Class A rating, the skylight must pass each of the Intermittent-Flame Test of Section 5, the Spread-of-Flame Test of Section 6, and the Burning-Brand Test of Section 7.

The Intermittent-Flame Test requires the skylight structure to withstand an intermittent luminous gas flame applied to its upper side for fifteen two-minute cycles without sustained flaming on its underside, production of flaming or glowing brands, displacement of portions of the test sample, or exposure or falling away of portions of the structure.

The Spread-of-Flame Test requires the skylight structure to withstand a continuous luminous gas flame applied thereto for 10 minutes, or until flaming of the material being tested permanently recedes from a point of maximum spread, whichever is shorter. The structure is then examined for distance to which the flame has spread, production of glowing brands, and displacement of portions of the structure.

The Burning-Brand Test requires the skylight structure to withstand a burning brand consisting of a grid 12 inches square and approximately 2 ¼ inches thick, made of kiln-dried Douglas fir lumber. The brand is made of 36 strips of lumber each ¾ inch by ¾ inch square by 12 inches long, placed in three layers of 12 strips each, with strips placed ¼ inch apart. The brand is ignited on all sides and subsequently placed on the surface of the skylight structure at the location considered most vulnerable. The burning brand remains on the skylight structure until it is consumed and until all evidence of flame, glow, and smoke has disappeared. During and after the test, the structure is examined for the appearance of sustained flaming on its underside, production of flaming or glowing brands, displacement of the test sample, and the exposure or falling away of portions of the roof deck. Glowing material falling through the skylight structure is unacceptable.

One plastic skylight structure which has been found to meet these criteria consists of a pair of thermoset resin fiberglass sheets bonded on either side of a grid core formed of aluminum beams, with the spacing between the sheets filled in by fiberglass insulation. This arrangement has been found to suffer from numerous shortcomings; most principally, the efficiency of light transmission, the weathering performance, the impact strength and the use of adhesive bond for their performance.

It is desirable to provide a skylight structure having plastic panels which is capable of satisfying the aforementioned fire safety criteria, while providing greater performance such as better light transmission than current designs, weathering, and impact strength. Moreover, it is desired to provide such a skylight structure which is also inexpensive and easy to assemble.

SUMMARY OF THE INVENTION

In accordance with the present invention, a skylight structure is provided formed with plastic panels which is capable of meeting the aforementioned ASTM E-108 "Class A" fire safety criteria. In accordance with one aspect of the safety criteria, the skylight structure can withstand burning embers or brands placed thereon without the brands burning completely through the skylight and entering the building. The plastic panel skylight of the present invention provides improved performance characteristics over current fire-safe skylights.

A first, upper plastic sheet is maintained in spaced parallel relation to a second, lower plastic sheet by spacing members so as to define a spacing between the first and second sheets, with the preferred sheets being thermoplastic. Within this spacing, insulating means is inserted to reduce thermal transmission across the skylight. Insulating means is selected having good light transmitting characteristics to minimize impedance of light passage through the skylight. Also within the spacing between the first and second sheets, and preferably immediately adjacent the lower second sheet, extends a metal screen, or other supporting means, having a sufficiently high melting point and strength that the supporting means remains intact when subjected to the heat and pressure associated with supporting a burning brand.

The assembly of the first and second plastic sheets, together with the insulation and the supporting means, produces sections of skylight structure, which individual sections are joined together by battens to form an elongated skylight unit. The skylight is supported about its periphery by sill brackets, and includes narrow, metal spacer beams which are preferably I-beams and extend generally transverse to the battens, and which maintain the first and second plastic sheets in generally parallel, spaced relation. The spacer beams are spaced sufficiently close together that a burning brand placed on the skylight will usually rest at least in part on at least one of the beams, and most likely will rest on two of the beams, to provide support of the brand and prevent the brand from falling through the skylight, and prevent flame spread.

The upper and lower panels are preferably formed of thermoplastic polycarbonate because of its good light transmitting, impact strength and weathering characteristics. However, it is recognized that panels of thermoplastic will deform and give way when acted upon by a burning ember, allowing the ember to fall through the panel. The provision of the screen at the lower panel, prevents the dropping embers from passing completely through the skylight, even with employment of thermoplastic panels.

In one prior art skylight, discussed above, fiberglass panels, having a layer of fiberglass insulation therebetween, are employed and are capable of passing the "Class A" fire rating. The panels are treated with chemicals to minimize burning of the plastic. There are two particular problems with this prior art embodiment which are solved by the skylight structure of the present invention.

First, the fiberglass panels do not transmit light as effectively as thermoplastic panels, have a low impact strength and poor appearance. The provision of the screen allows for employment of the more light-transmitting panels since the screen prevents burning embers from falling through the skylight, so that it is not necessary for the panels themselves to be fiberglass and to resist the embers. Fire-safe skylight structures constructed in accordance with the present invention and employing thermoplastic panels have been found to provide better performance than prior art fire-safe skylight structures.

Second, the chemicals used to treat the fiberglass panels often become discolored when subjected to weathering or high temperatures. The screen also precludes the need to apply fire resistant chemicals to the plastic panels as the screen acts to prevent passage of burning embers through the skylight so that preventing burning of the embers through the plastic sheets is not necessary.

Accordingly, a skylight structure is provided having improved fire resistant characteristics and improved performance as compared to currently manufactured skylights. The skylight structure precludes the need to apply chemicals thereto, and lends itself to low cost production and easy assembly.

BRIEF DESCRIPTION OF THE DRAWINGS

In the drawings, wherein like elements are referenced alike.

DETAILED DESCRIPTION OF THE PREFERRED EMBODIMENTS

Figure 3:
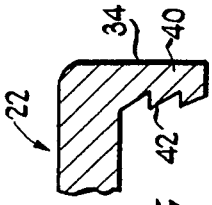
FIG. 3 is an enlarged fragmentary view of the H-batten engaging lateral end of the upper panel of FIG. 2.

A skylight structure embodying various features of the present invention is illustrated in FIGS. 1–9 and referred to generally by reference numeral 20. With initial reference to the cross-sectional view of FIG. 2, the illustrated skylight structure 20 comprises a first, upper polymeric panel 22 and a second, lower polymeric panel 24 maintained in parallel, spaced relation, to one another to define a spacing 26 therebetween. A metal screen 28 and light transmitting insulation 30 are disposed within the spacing 26, with the screen 28 secured immediately adjacent the second, lower panel 24, and the insulation resting upon the screen 28.

Figure 2:
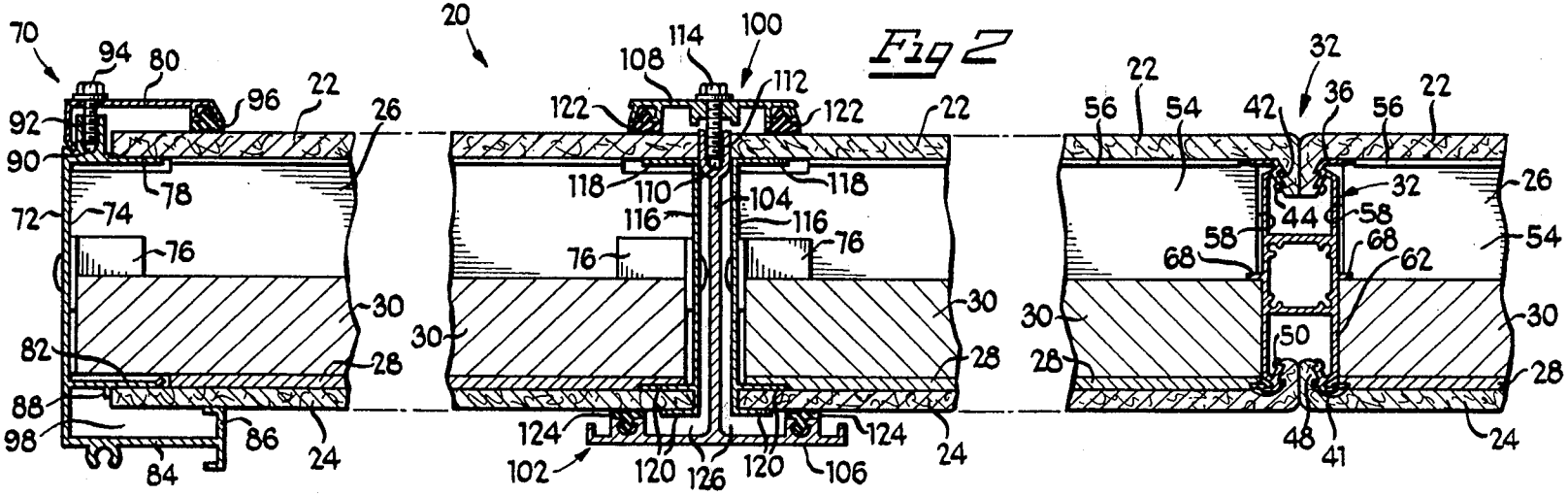
FIG. 2 is a fragmentary sectional view of a skylight structure embodying various features of the present invention.

The upper and lower panels 22 and 24 are maintained in spaced relation by H-battens 32 which engage the lateral ends 34 of adjacent upper panels 22 at the upper end 36 of the H-battens 32, and engage the lateral ends 38 of adjacent lower panels 24 at the lower end 40 of the H-battens 32, as illustrated in the right side of FIG. 2.

Figure 4:
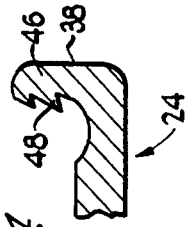
FIG. 4 is an enlarged fragmentary view of the H-batten engaging lateral end of the lower panel of FIG. 2.

The respective lateral ends 34 and 38 of the upper panel 22 and lower panel 24 are illustrated in FIGS. 3 and 4. The lateral ends 34 of the upper panels 22 are defined by downwardly depending upper skirts 40 having a plurality of longitudinally extending, parallel ribs defining a saw-toothed interior surface 42 (see FIG. 3). As seen in FIG. 2, the saw-toothed interior surfaces 42 of two adjacent upper skirts 40 are slidably received between, and engage with, opposing complementary upper saw-toothed surfaces 44 provided at the upper end 36 of the H-batten 32. The opposing upper saw-toothed surfaces 44 of the H-batten 32 are spaced from one another in proportion to the thickness of the upper skirts 40 so that the adjacent lateral ends 34 of the upper panels 22 abut one another and fit tightly between the opposing saw-toothed surfaces 44. Thereby, the saw-toothed interior surfaces 42 of the panel skirt 40 are maintained pressed flush against the complementary upper saw-toothed surfaces 44 of the H-batten to securely retain the lateral ends 34 of the upper panel 22 adjacent one another at the upper end 36 of the H-batten 32.

Similarly, the lateral ends 38 of the lower panels 24 are defined by upwardly depending lower skirts 46 having a lower saw-toothed interior surface 48 (see FIG. 4). With continued reference to FIG. 2, the lower saw-toothed interior surfaces 48 of two adjacent lower skirts 46 are slidably received between, and engage with, opposing complementary lower saw-toothed surfaces 50 provided at the lower end 40 of the H-batten 32.

As with the engagement at the upper end 36 of the H-batten 32, the opposing lower saw-toothed surfaces 50 of the H-batten 32 are spaced from one another in proportion to the thickness of the lower skirts 40 so that the adjacent lateral ends 38 of the lower panels 22 abut one another and fit tightly between the opposing lower saw-toothed surfaces 50. Thereby, the lower saw-toothed interior surfaces 48 of the panel skirt 48 are maintained pressed flush against the complementary lower saw-toothed surfaces 50 of the H-batten 32 to securely retain the lateral ends 38 of the lower panels 24 adjacent one another at the lower end 40 of the H-batten 32.

The H-battens 32 are formed of metal or other suitable material capable of withstanding the high heat associated with fire conditions. The H-battens 32 are also preferably light weight and inexpensive to produce, and in this regard the H-battens 32 are preferably formed by extrusion molding of aluminum.

Figure 7:
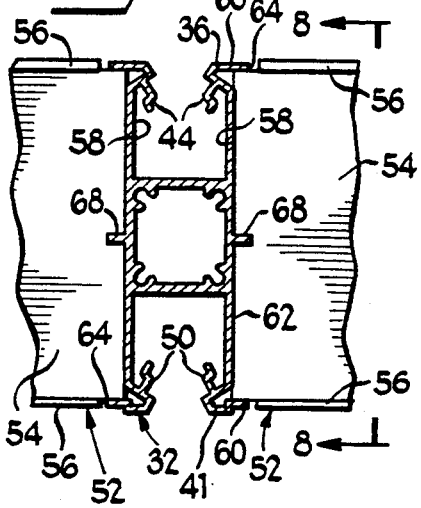
FIG. 7 is an enlarged, fragmentary sectional view of the H-batten.
Figure 8:
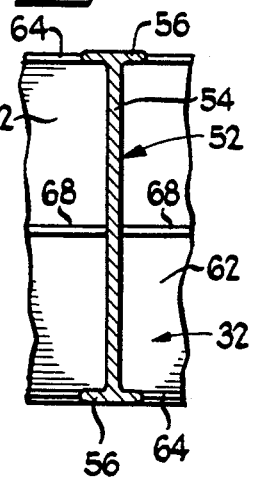
FIG. 8 is a cross-sectional view taken along line 8—8 of FIG. 7, illustrating the I-beam.

To provide additional structural support to the skylight structure 20 to withstand the weight of burning brands and delay flame spread, spacer beams or I-beams 52 are provided which extend between the H-battens 32, transversely thereto. The I-beams 52 have an elongated vertical flange 54 terminating at its upper and lower ends at narrow transverse upper and lower flanges 56. To accommodate engagement of the lateral ends 58 of the I-beams 52 with the H-battens 32, the upper and lower flanges 56 of the I-beams 52 terminate short of the lateral end 58, with the vertical flange 54 extending beyond the upper and lower flanges 56. As best seen in FIG. 7, the vertical flange 54 at the lateral end 58 of the I-beam 52 is received between the upper and lower lips 60 of the H-batten 32, adjacent the sidewall 62 of the H-batten 32, with the recessed upper and lower flanges 56 of the I-beams 52 nearly abutting the respective ends 64 of the upper and lower lips 60. As with the H-battens 32, the I-beams 52 are preferably formed of extruded aluminum due to its light weight, and are preferably formed narrow, having narrow upper and lower flanges 56 to minimize the amount of impedance to light transmission and cost.

Segments of I-beams 52 are secured transversely between adjacent H-battens 32 by interlocking upper and lower flanges 54 of the I-beams 52 to the respective upper and lower lips 60 of the H-battens 32. Additionally, angle brackets may be employed to further secure the I-beams 52 to the H-battens 32, as described in detail below with regard to connection of the spacer beams or I-beams 52 to other structural members.

The polymeric panels 22 and 24 are preferably formed into rectangular shapes having a forward to rearward length corresponding to the overall length of the skylight structure, and having a width between lateral sides 34 and 38 of the panels 22 and 24 corresponding to the span between adjacent H-battens 32. Thus, in the final construction, the skylight structure 20 has a plurality of adjacent and parallel polymeric panels 22 and 24 at its upper side and lower side, respectively, which panels all extend continuously from the forward side of the overall skylight structure 20 to the rearward side of the overall skylight structure 20. The gridwork formed by the interconnected H-battens 23 and I-beams 52 is entirely disposed in the spacing 26 between the upper panel 22 and lower panel 24, so that in the final construction none of the metal of the H-battens 32 or the I-beams 52 is exposed. This is important in order to provide good aesthetic appearance.

Figure 1:
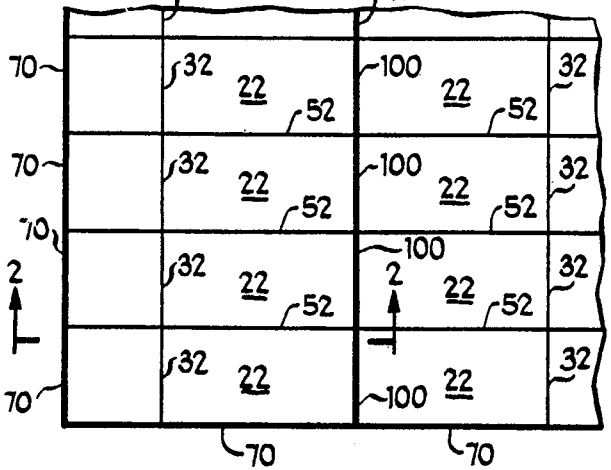
FIG. 1 is a schematic plan view of the skylight structure of the present invention.

The metal gridwork is produced by assembling a plurality of H-battens 32 and I-beams 52 as represented schematically in FIG. 1. While, manifestly, the spacing between both the H-battens 32 and I-beams 52 may be any size, there are at least three important factors which must be taken into account in determining the desired spacing.

First, in order for some configurations of skylight structure 20 to pass the aforementioned burning brand test and receive a Class A fire rating, the I-beams 52 must be placed sufficiently close together in relation to the size of the burning brand to be supported and to the amount of flame which is generated. In accordance with ASTM E-108, the burning brands are 12 inches square, and the I-beams 52 are preferably spaced from one another not more than this twelve inch span to assure that at least a portion of the burning brand will rest upon and be supported by at least one of the I-beams 52.

Second, to provide increased structural support to withstand the load of burning brands, it is desired to place the I-beams 52 very close together. This increases the likelihood of a brand being supported on two or more I-beams. However, the third interest which must be taken into account is that of optimizing the amount of sunlight which passes through the skylight structure 20 and the cost. In this regard, it is desired that the I-beams 52, which are opaque, be spaced as far apart from one another as possible. In striking a balance between these interests, by way of example, a skylight structure having I-beams 52 spaced 12 inches apart has been found to provide sufficient structural support to withstand the high temperature loads associated with burning brand tests, yet also provide sufficient spacing between I-beams 52 to allow the skylight structure 20 to transmit a large amount of light.

To prevent burning embers from burning completely through the skylight structure, lengths of screen 28 are secured adjacent the lower panel 24 and maintained taut by the metallic gridwork. The screen is preferably metallic, non-compressible and non-rusting so as to withstand the high temperature loading associated with burning embers. Stainless steel is particularly well suited for this purpose. More specifically, a burning ember may burn through the polymeric upper panel 22 and through the layer of fiberglass insulating material 30. The screen 28 prevents the burning ember from subsequently burning through the lower panel 24 and into the building. Sections of screen 28 fit between each of the adjacent H-battens 32 and extend from the forward end of the skylight structure 20 to the rearward end of the skylight structure. Hence, the screen 28 is supported by a metal framework so that even upon burning away of the plastic components of the skylight structure, the screen remains taut along the underside of the structure, in position to prevent embers from falling completely through the skylight structure.

In accordance with an important aspect of the skylight structure 20 of the present invention, the upper and lower polymeric panels 22 and 24 may be formed of thermoplastic materials. While thermoplastic materials are generally undesirable in the construction of firesafe skylights due to their loss of integrity and strength at the temperatures involved in these tests not supporting a burning ember burning through the upper panels and into the building, the screen 28 provided in skylight structures 20 constructed in accordance with the invention provides the requisite impedance to the burning ember to prevent the ember from entering the building, as required to pass the aforementioned Class A fire rating test.

Previously, thermosetting plastic panels filled with fire retardant chemicals have been employed due to their resistance to deformation and loss of integrity and loss of strength at the temperatures involved in these tests. Since thermoplastic panels transmit light significantly more efficiently than thermoset panels, and offers better performance, such panels are desirable to optimize light transmission through the skylight structure. The provision of the screen 28 allows for employment of the more light transmitting thermoplastic panels, while still providing the requisite resistance to a burning ember. Thermoplastic panels also have good weathering characteristics, and do not become discolored when subjected to weathering, which is in contrast with the conventionally employed thermoset plastic panels which are readily discolored when exposed to weathering and require significant chemical treatment to prevent discoloration.

Light transmitting insulating material 30, such as fiberglass, is disposed on top of the screen 28 and is received beneath the short tabs 68 extending outward from the midspan of the sidewalls 62 of the H-battens 52 and extending along the length of the H-battens, to maintain the layer of insulating material 30 at the lower end of the spacing 26, adjacent the screen 28. Where such tabs 68 are provided, a narrow slit must be formed therein to accommodate the vertical flange 54 of the I-beams 52.

The insulating material 30 is preferably of fiberglass or the like. Thus, even if the upper thermoplastic panel 22 burns away when subjected to flames, the insulating material 30 acts as a barrier to the flames to prevent the flames from impinging the lower panel 24. The insulating material acts as an insulation to keep the temperature of the lower glazing panel from rising as fast as it would rise in the absence of any heat insulating material. Thus, the insulating material assists the lower thermoplastic panel 24 to remain intact during the aforementioned Intermittent-Flame Test and Spread-of-Flame Test, wherein the upper panel is subjected to flames.

Thus, upper and lower thermoplastic panels 22 and 24, respectively, are maintained in parallel relation, having a fire resisting, non-combustible core comprising a screen 28 disposed adjacent the lower panel 4, in the spacing 26 between the upper and lower panels 22 and 24, and fire resisting, light transmitting insulation 30 disposed on the screen 28. Accordingly, an assembly is provided having good light transmitting characteristics which is capable of meeting all of the fire resisting requirements of ASTM E-108.

The present invention can have upper and lower panels of thermosetting plastic rather than the preferred thermoplastic panels. The fire resisting core of a metal screen 28, insulating fibers 30 and beams 52 will also work with thermosetting plastic panels.

Figure 5:
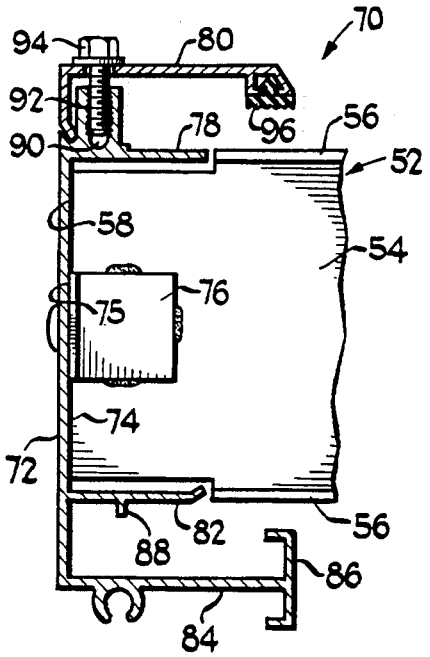
FIG. 5 is an enlarged sectional view of the sill frame of FIG. 2.

To mount and secure the skylight structure 20 to an opening in a building roof, sill frames 70, as shown in FIG. 5 and the left side of FIG. 2, are secured about the perimeter of the opening. The sill frames 70 are elongated C-shaped members having a rear wall 72 secured to the roof, and extending along the entire lengths of the roof opening perimeter, including both the lateral sides and forward and rearward sides of the roof opening.

Purlins in the form of I-beams 52 extend to, and are connected transversely to, the interior surface 74 of the rear wall 72 of the sill frames 70 by angle brackets 76 as shown in FIGS. 2 and 5. A pair of angle brackets 76 are employed with one on either side of each I-beam 52. The angle brackets 76 have perpendicular surfaces 75 and 77, with surface 75 riveted to the rear wall 72 and surface 77 welded to the vertical flange 54 of the I-beams 52 to secure the I-beams 52 perpendicularly to the rear walls 72 of the sill frames 70.

The sill frame 70 is extrusion molded and comprises an inner upper leg 78, outer upper leg 80, inner lower leg 82 and outer lower leg 84, each extending transversely to the interior surface 74 of the rear wall 72. As seen in FIG. 2, the inner upper leg 78 and the inner lower leg 82 serve as spacing means to maintain separation of the upper and lower plastic panels 22 and 24. The outer lower leg 84 terminates at a T-shape, having a vertical segment 86 extending transversely to the outer lower leg 84. The inner lower leg 82 includes a downwardly depending stopping projection 88. With continued reference to FIG. 2, the lower polymeric panel 24 is slidably received between the inner lower leg 82 and the vertical segment 86 of the outer lower leg 84, with the stopping projection 88 serving as a stop to define the extent of inward sliding of the lower panel 24.

The upper panel 22 is received between the inner upper leg 78 and the outer upper leg 80, which is adjustable in the direction of the lower legs to clamp the upper panel 22 securely. Integral with the sill frame 70 is a U-shaped channel 90 having serrated interior surfaces 92 which threadably engage with bolts 94 or other threaded members. Tightening of the bolts 94 lowers the outer upper leg 80 and clamps it tightly down against the upper panel 22. Rubber gaskets 96 are provided at the engaging ends of the outer upper legs 80 to form a weather-proof seal with the upper panel 22, and also prevent slippage of the upper panel 22 from between the upper outer leg 80 and the upper inner leg 78.

Accordingly, the assembled skylight structure 20 includes a sill frame 70 extending about its entire perimeter, which sill frame 70 is mounted to the roof opening to support and secure the skylight structure. The additional space 98 between the lower inner leg 82 and the lower outer leg 84 serves as a gutter to accumulate and drain off water which may seep through the gasket seal, to prevent the water from dripping down into the building.

Since there may be a large span from one lateral side of the skylight structure to the other, it may be required to provide additional support to the structure 20 in addition to that provided by the sill frames 70. That is, additional structural support to the interior portions of the skylight structure 20 may be desired for large skylights.

Figure 6:
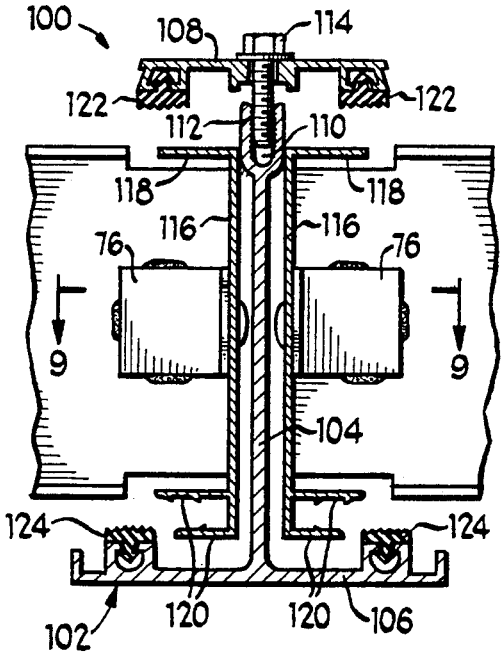
FIG. 6 is an enlarged, fragmentary sectional view of the connecting bracket of FIG. 2.

Additional structural support to the skylight structure 20, which allows the use of flat plastic sheets, is provided by connecting purlins or rafters 100, such as that shown in cross section in FIG. 6, and the center of FIG. 2. The illustrated connecting rafter 100 is I-shaped, and comprises an inverted T-shaped lower portion 102 consisting of a vertical wall 104 terminating at a horizontal flange 106, which is preferably a glazing bar. An upper flange 108 is threadably connected to the lower T-shaped portion 102 in the manner described above with regard to the sill frame 70. That is, the vertical flange 104 terminates at its upper end at a U-shaped recess 110 having serrated sidewalls 112 which threadably engage nuts 114 or other threaded members passed through the upper flange 108. Hence, tightening of the bolts 114 clamps the upper flange 108 downward.

Separating brackets 116 having upper panel supporting leg 118 and a pair of lower panel engaging legs 120 maintain the spacing 26 between the upper panel 22 and lower panel 24. The lower panel 24 is slidably received between the pair of lower panel engaging legs 120, and the upper panel 22 is received between the upper panel supporting leg 118 and the upper flange 108. Tightening of the bolt 114 brings the upper flange 108 and the lower flange 106 toward one another, thereby securing a pair of upper panels 22 between the gaskets 122 of the upper flange 108 and the upper panel supporting leg 118, and also securing a pair of lower panels 24 between the gaskets 124 of the lower flange 106 and the lower panel engaging leg 120. The connecting rafter 100 extends from the forward end of the skylight structure to the rear end, spanning the entire opening in the roof to provide structural support to the skylight structure 20.

Figure 9:
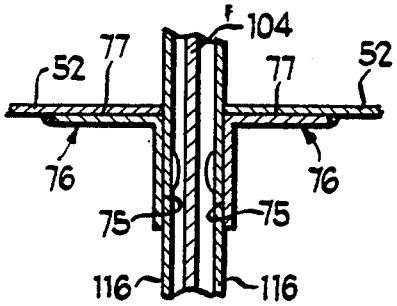
FIG. 9 is a cross-sectional view taken along line 9—9 of FIG. 6, illustrating the angle bracket connections.

The purlin I-beam sections 52 are connected transversely to the connecting rafters 100 by angle brackets 76 in the manner discussed above with regard to the H-battens 32. The cross-sectional view of FIG. 9 illustrates this I-beam connection. As seen in FIG. 2, the rafter 100 includes a pair of condensate collecting channels 126 on either side of the vertical flange 104, between the lower flange 106 and the underside of the lower panels 24. Moisture seeping through the seal of the gaskets 122 is collected in this channel 126 and thus does not drip into the building.

An assembled skylight structure 20 constructed in accordance with the illustrated embodiment meets the aforesaid Class A fire rating test. By way of example only, one such skylight structure 20 was constructed having purlin I-beams 52 spaced 1.0′ apart, and H-battens spaced 1′ 11 9/16 apart, which spacing was found to meet the requirements of a Class A rating.

Specifically, during the Intermittent-Flame Test and the Spread-of-Flame Test, while the upper thermoplastic panel may burn away when subjected to the flame, the layer of fiberglass insulation, protects the lower thermoplastic panel from the flame and temperature rise to the extent that the skylight structure 20 will pass these tests when thermoplastic panels are employed. The upper panel 22 serves to protect the interior portions of the skylight structure from weathering, and need not be capable of withstanding fire itself.

During the Burning-Brand Test, at least a portion of the weight of the burning brand will usually rest on an I-beam to provide some support for the burning brand. The upper panel may burn away at the location of the burning brand thereon; however, the fiberglass, provides resistance to the path of burning, and the brand is prevented from burning completely through the skylight structure by the metal screen the bottom of the structure. The metal screen is supported by the metal framework so that even upon burning away of the plastics, the metal screen remains taut along the underside of the structure to prevent burning materials from entering the building.

While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A sloped plastic glazing panel structure having fire resisting capability, comprising:

a skylight framework disposed at an angle to the vertical;

a first polymeric panel of thermoplastic material having light transmitting characteristics and held by the framework at an angle to the vertical to transmit light downwardly;

a second polymeric panel having light transmitting characteristics for transmitting light downwardly and held by the framework to be substantially parallel to the first polymeric panel;

means on the framework for maintaining said second panel in spaced relation to said first polymeric panel with a space being defined between said first and second panels;

a light transmitting, insulating layer having an upper surface for receiving embers from a burning brand and melted plastic from the first polymeric panel of thermoplastic material and disposed in said space and beneath the first polymeric panel for reducing thermal transmission from a burning brand on the first polymeric panel downwardly across the space to the second polymeric panel to burn through the second polymeric panel; and a light transmitting, supporting means disposed beneath the first panel and above the second panel, and in said space for holding burning particles from a burning brand from falling downwardly onto the second panel and burning through the second panel and passing through the second panel.

2. A skylight structure in accordance with claim 1 wherein said first and second polymeric panels are comprised of thermoplastic materials.

3. A skylight structure in accordance with claim 1 wherein said insulating means comprises a layer of loose glass fibers.

4. A skylight structure in accordance with claim 1 wherein said supporting means comprises a plurality of spacer beams extend laterally across at least one of first and second panels.

5. A skylight structure in accordance with claim 1 in which the panels are made of fiberglass.

6. A skylight structure in accordance with claim 1 wherein said supporting means is disposed immediately adjacent said second panel.

7. A sloped plastic glazing panel structure capable of resisting fire from burning brands of predetermined size and the spread of flame from a fire, comprising:

a frame disposed at an angle to the vertical;

a first thermoplastic panel supported by said frame at an angle to the vertical and to transmit light downwardly;

a second thermoplastic panel supported by said frame and spaced from said first panel and extending parallel to the first thermoplastic panel and to transmit light downwardly;

a light transmitting, insulating layer having an upper surface for receiving embers from a burning brand and melted plastic from the first thermoplastic panel and disposed beneath the first thermoplastic panel and in said space for reducing thermal transmission downwardly across the space while still transmitting light downwardly;

a light transmitting, particle member disposed beneath the first thermoplastic panel and in said space for preventing passage of particles of said burning brands from dropping downwardly onto the second thermoplastic panel and melting the second panel; and a plurality of spacer beams in said frame dividing the first and second panels into modules to resist spreading of the fire from burning brands and to resist the spread of flame from a fire from a spread-of-flame test.

8. A skylight structure in accordance with claim 7 wherein said insulating means comprises a layer of loose glass fibers.

9. A skylight structure in accordance with claim 8 wherein said spacer beams are spaced generally uniformly from one another.

10. A skylight structure in accordance with claim 7 wherein said spacer beams comprise narrow I-beams.

11. A sloped plastic glazing panel structure capable of meeting burning brand and spread of fire tests comprising:

a frame disposed at an angle to the vertical;

an upper polymeric panel supported by the frame in a position at an angle to the vertical to receive a burning brand thereon and to transmit light downwardly;

a lower polymeric panel supported by the frame in a plane substantially parallel to the upper panel for transmitting light downwardly and defining an interior space with the upper panel; and a fire resistance core disposed in said space between the panels and having a non-combustible screen and rigid support members for holding the burning brands against passing through the lower polymeric panel located beneath the fire resistance core and for resisting the spread of flame from a fire from a spread-of-flame test.

12. A sloped plastic, glazing panel structure having fire resisting capability, comprising:

a framework disposed at an angle to the vertical;

a first polymeric panel having light transmitting characteristics and held by the framework at an angle to the vertical for transmitting light downwardly therethrough;

a second polymeric panel having light transmitting characteristics and held by the framework to be substantially parallel to the first polymeric panel;

means on the framework maintaining said second panel in spaced relation to said first polymeric panel with a space being defined between said first and second panels;

a light transmitting, insulating layer having an upper surface for receiving embers from a burning brand and disposed in said space for reducing thermal transmission downwardly across the space to the second polymeric panel;

a light transmitting, supporting means disposed in said space for holding burning particles from falling downwardly onto the second panel and burning through and passing through the second panel; and said supporting means comprising a non-combustible screen.

13. A skylight structure in accordance with claim 12 wherein the screen is made of metal.

14. A skylight structure in accordance with claim 13 wherein the spacing between said spacer beams corresponds to the size of a standardized burning brand, with the spacing providing for at least a portion of the burning brand to be supported upon at least one of said spacer beams.

15. A sloped plastic glazing panel structure having fire resisting capability, comprising:

a skylight framework disposed at an angle to the vertical;

a first polymeric panel having light transmitting characteristics and supported by the framework at an the vertical to transmit light downwardly;

a second polymeric panel having light transmitting characteristics and supported by the framework at the angle to the vertical;

the framework maintaining said second panel in spaced relation to said first polymeric panel with a space being defined between said first and second panels; and a core for resisting burning brands and the spread of flame by fire;

a light transmitting, insulating layer having an upper surface for receiving embers from a burning brand and disposed in said core and in the space for reducing thermal transmission downwardly across the space to the second polymeric panel; and a light transmitting, supporting means disposed in said core and in the space for holding burning particles from falling downwardly onto the second panel and and burning through and passing through the second panel; and said supporting means comprising a screen being made of metal and being disposed adjacent said second panel.

16. A skylight structure in accordance with claim 15, wherein said supporting means includes a metal screen and a plurality of beams located between the first and second panels.

17. A sloped plastic glazing panel structure capable of resisting burning brands of predetermined size and the spread of flame from a fire, comprising:

a frame disposed at an angle to the vertical;

a first thermoplastic panel supported by said frame at an angle to the vertical and to transmit light downwardly;

a second thermoplastic panel supported by said frame and spaced from said first panel and to transmit light downwardly;

a light transmitting, insulating layer having an upper surface for receiving embers from a burning brand and melted plastic from the first thermoplastic panel and disposed in said space for reducing thermal transmission downwardly across the space;

a light transmitting, particle supporting means disposed in said space for preventing the downward passage of particles of said burning brands therethrough; and said frame having a plurality of spacer beams in to support burning brands, said particle supporting means comprising a non-combustible screen and cooperating with said insulating means and said spacer beams to resist burning from burning brands and the spread of flame from a fire.

18. A skylight structure in accordance with claim 17 wherein the particle supporting means comprises a screen made of metal.

* * * * *

UNITED STATES PATENT AND TRADEMARK OFFICE

CERTIFICATE OF CORRECTION

PATENT NO. :5,437,129

DATED :August 1, 1995

INVENTOR(S) :Konstantin

It is certified that error appears in the above-indentified patent and that said Letters Patent is hereby corrected as shown below:

IN THE CLAIMS:

Column 10, line 12, after "beams" add --which--.

Column 11, line 48, after "an" add --angle to--.

Column 12, line 14, after "panel" delete "and" (first occurrence).

Signed and Sealed this

Fifth Day of December, 1995

*Attest:*

*Attesting Officer*

BRUCE LEHMAN

*Commissioner of Patents and Trademarks*